US007857585B2

(12) United States Patent
Dhaliwal

(10) Patent No.: US 7,857,585 B2
(45) Date of Patent: Dec. 28, 2010

(54) GAS TURBINE ENGINE COMPRISING A CASING SURROUNDING A ROTARY ASSEMBLY AND A MANIFOLD SECURED TO THE CASING VIA A SECURING ARRANGEMENT

(75) Inventor: Kamaljit Kaur Dhaliwal, Birmingham (GB)

(73) Assignee: Rolls-Royce, PLC, London (GB)

( * ) Notice: Subject to any disclaimer, the term of this patent is extended or adjusted under 35 U.S.C. 154(b) by 882 days.

(21) Appl. No.: 11/137,424

(22) Filed: May 26, 2005

(65) Prior Publication Data

US 2006/0016173 A1 Jan. 26, 2006

(30) Foreign Application Priority Data

Jun. 23, 2004 (GB) ..... 0414043.0

(51) Int. Cl.
*F01D 25/28* (2006.01)
*F02C 7/20* (2006.01)
*F02C 7/12* (2006.01)

(52) U.S. Cl. ..... 415/213.1; 60/796; 60/806

(58) Field of Classification Search ..... 285/407, 285/408, 411, 420; 60/739, 796, 798; 248/554, 248/555; 415/189, 190, 213.1
See application file for complete search history.

(56) References Cited

U.S. PATENT DOCUMENTS

| | | | | |
|---|---|---|---|---|
| 2,878,041 | A | 3/1959 | Hobbs | |
| 3,027,715 | A * | 4/1962 | Morris | 60/796 |
| 4,715,565 | A * | 12/1987 | Wittmann | 244/173.1 |
| 4,805,398 | A * | 2/1989 | Jourdain et al. | 60/806 |
| 4,840,026 | A | 6/1989 | Nash et al. | |
| 5,088,279 | A | 2/1992 | MacGee | |
| 5,127,224 | A * | 7/1992 | Barcza et al. | 60/763 |
| 5,205,115 | A * | 4/1993 | Plemmons et al. | 60/806 |
| 5,205,708 | A * | 4/1993 | Plemmons et al. | 415/173.1 |
| 5,271,218 | A * | 12/1993 | Taylor | 60/797 |
| 5,277,382 | A * | 1/1994 | Seelen et al. | 244/54 |
| 6,357,220 | B1 * | 3/2002 | Snyder et al. | 60/796 |
| 6,682,015 | B2 * | 1/2004 | Levert et al. | 244/54 |
| 2002/0069647 | A1 * | 6/2002 | Mayersky et al. | 60/796 |

FOREIGN PATENT DOCUMENTS

| | | |
|---|---|---|
| DE | 101 50 527 A1 | 6/2002 |
| GB | 726072 | 3/1955 |
| GB | 2 292 976 A | 3/1996 |

* cited by examiner

*Primary Examiner*—Michael Cuff
*Assistant Examiner*—Gerald L Sung
(74) *Attorney, Agent, or Firm*—Oliff & Berridge, PLC

(57) ABSTRACT

A securing arrangement for securing a manifold to a casing (surrounding a rotary assembly) is disclosed the securing arrangement comprises a bracket defining a recess co-operable with a radially extending part of the casing. Securing means, provide to secure the bracket to the aforesaid radially outwardly extending part.

26 Claims, 8 Drawing Sheets

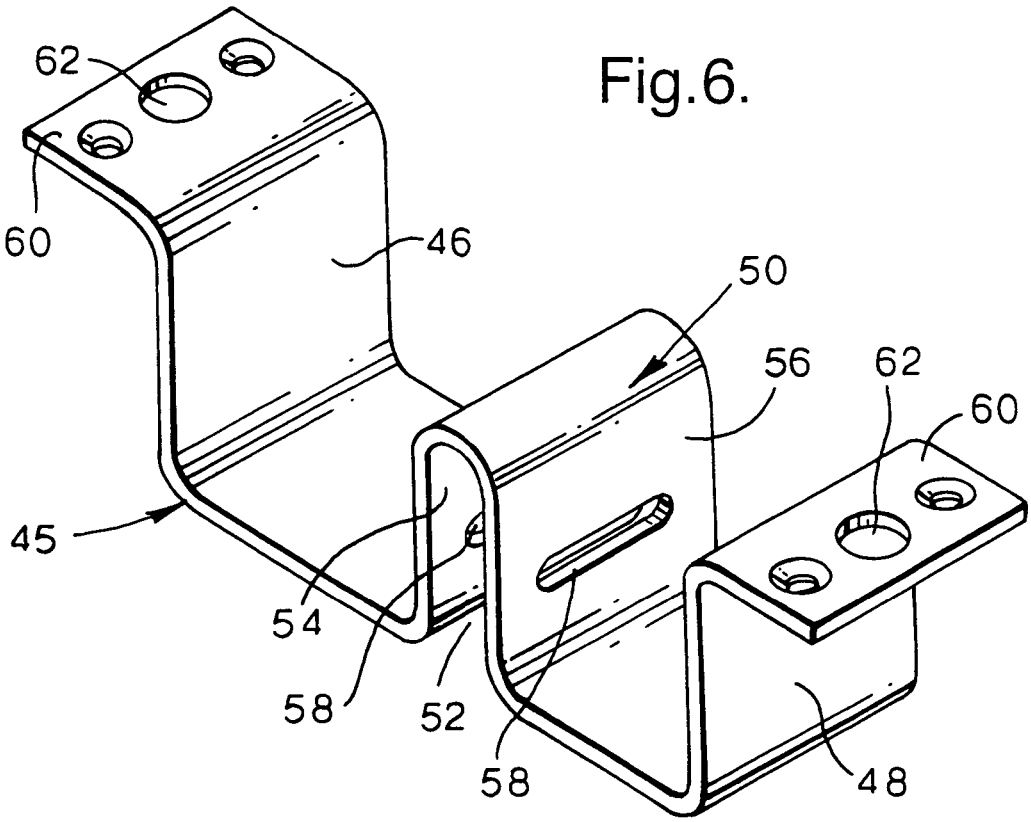
Fig.6.
Fig.7.
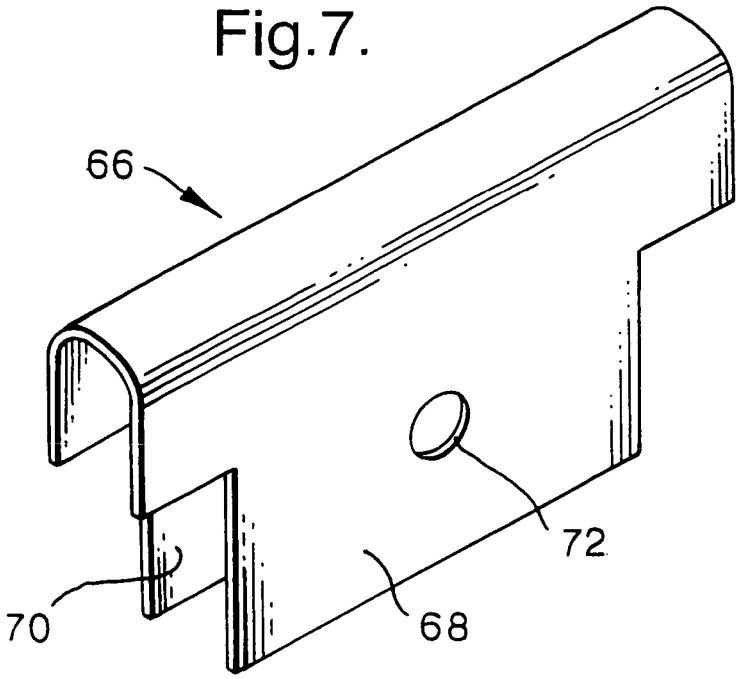

GAS TURBINE ENGINE COMPRISING A CASING SURROUNDING A ROTARY ASSEMBLY AND A MANIFOLD SECURED TO THE CASING VIA A SECURING ARRANGEMENT

This invention relates to securing arrangements. More particularly, but not exclusively, the invention relates to securing arrangements for securing a manifold to a casing surrounding a rotary component of a gas turbine engine.

Cooling air for the high pressure turbine is supplied to the casing surrounding the turbine via a manifold. The manifold is attached to the casing by means of several forwards and rearwards brackets. This is disadvantageous in terms of weight, the number of parts and the assembly time.

According to one aspect of this invention, there is provided a securing arrangement for securing a first component to a second component, the securing arrangement comprising a bracket defining a recess for receiving a part of the second component, and securing means co-operable with said part of the second component to secure the bracket to said part of the second component.

According to one aspect of this invention, there is provided a securing arrangement for securing a manifold to a casing surrounding a rotary assembly, the securing arrangement comprising a bracket defining a recess co-operable with a radially outwardly extending part of the casing, and securing means for securing the bracket to the aforesaid radially outwardly extending part.

The securing means may comprise an insertion means insertable into the aforesaid part. The insertion means may comprise an insertion member, such as a pin. Preferably, the insertion member is insertable into an aperture in the aforesaid part. The aforesaid part may comprise a flange.

The rotary assembly may be a component of a gas turbine engine. The rotary assembly may be a turbine assembly.

The insertion means may further comprise a bush having an aperture into which the pin can be inserted. Preferably, the bush is insertable into the aforesaid part.

Wear prevention means may be provided to prevent wear of the aforesaid part. The wear prevention means may comprise the bush. The bush may define an aperture into which the insertion member can be inserted. The wear prevention means is preferably formed of a suitable material to allow the bush to wear rather than the aforesaid part. A suitable such material is a steel material, such as stainless steel, The bracket may be of a W shaped configuration. Preferably, the bracket comprises an upstanding portion, which may define the aforesaid recess. Preferably, the upstanding portion is centrally provided on the bracket. The bracket may comprise outer walls and the upstanding portion may be provided between the aforesaid outer wall members.

The upstanding portion may define an aperture for the insertion member. The aperture may be a slot which may be defined to be, in use, generally parallel to the circumference of the manifold. Preferably, the slot is provided in the upstanding member to allow circumferential movement of the bracket on expansion of the casing. The upstanding member may comprise opposed wall members, and a slot may be provided in each wall member. The slots may be aligned with each other to allow the insertion member to extend through both slots.

Protection means may be provided between the bracket and the aforesaid part. The protection means may comprise a liner adapted to be arranged over the aforesaid radially outwardly extending part of the casing. The protection means may define an aperture through which the insertion member can be inserted. The liner may comprise an anti-fret liner to prevent wear of one or both of the bracket and the manifold.

The bracket may comprise opposite end portions to which the manifold can be secured fastened by fastening means. The fastener may comprise a bolt, and the end portions may define an aperture for receipt of a bolt to secure the bracket to the manifold.

According to another aspect of this invention, there is provided a manifold assembly comprising a manifold and a securing arrangement as described above for securing the manifold to a casing of a rotary component.

The manifold may have a main axis and may be generally annular in configuration.

The manifold may comprise an inlet member to allow fluid to enter the manifold. The inlet member may comprise an entrance face which may be non-parallel to the main axis of the manifold.

According to another aspect of this invention, there is provided a manifold assembly comprising a manifold having a main axis and a securing arrangement for securing the manifold to a casing on a rotary component, wherein the manifold comprises an inlet member to allow fluid to enter the manifold, the inlet member having an entrance face which is non-parallel to the main axis of the manifold.

The manifold assembly may comprise a securing arrangement as described above.

At least one embodiment of the invention will now be described by way of example only with reference to the accompanying drawings, in which:

FIG. 6 shows a bracket for use in securing the manifold to the casing;

FIG. 7 is an anti-fret liner;

Figure 1:
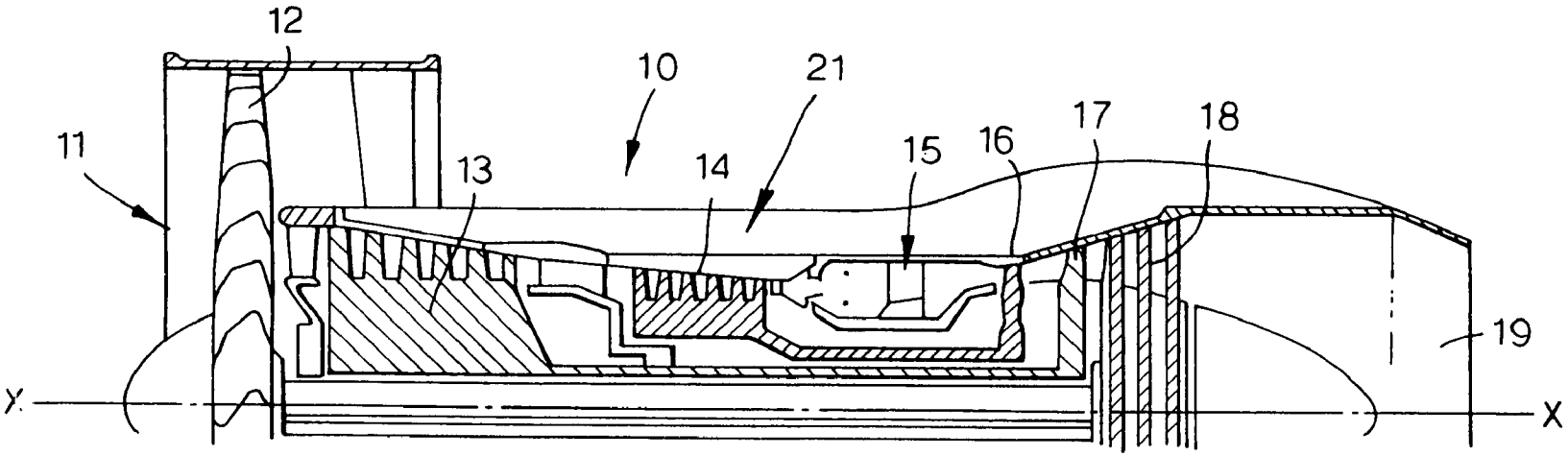
FIG. 1 is a sectional side view of the upper half of a gas turbine engine.

Referring to FIG. 1, a gas turbine engine is generally indicated at 10 and comprises, in axial flow series, an air intake 11, a propulsive fan 12, an intermediate pressure compressor 13, a high pressure compressor 14, combustor 15, a high pressure turbine 16, an intermediate pressure turbine 17, a low pressure turbine 18 and an exhaust nozzle 19.

The gas turbine engine 10 works in a conventional manner so that air entering the intake 11 is accelerated by the fan 12 which produce two air flows: a first air flow into the intermediate pressure compressor 13 and a second or by pass air flow which passes through a by pass region 21 of the engine to provide propulsive thrust. The intermediate pressure compressor compresses the air flow directed into it before delivering that air to the high pressure compressor 14 where further compression takes place.

The compressed air exhausted from the high pressure compressor 14 is directed into the combustion equipment 15 where it is mixed with fuel and the mixture combusted. The resultant hot combustion products then expand through, and thereby drive, the high, intermediate and low pressure turbines 16, 17 and 18 before being exhausted through the nozzle 19 to provide additional propulsive thrust. The high, intermediate and low pressure turbine 16, 17 and 18 respectively drive the high and intermediate pressure compressors 14 and 13, and the fan 12 by suitable interconnecting shafts.

Figure 2:
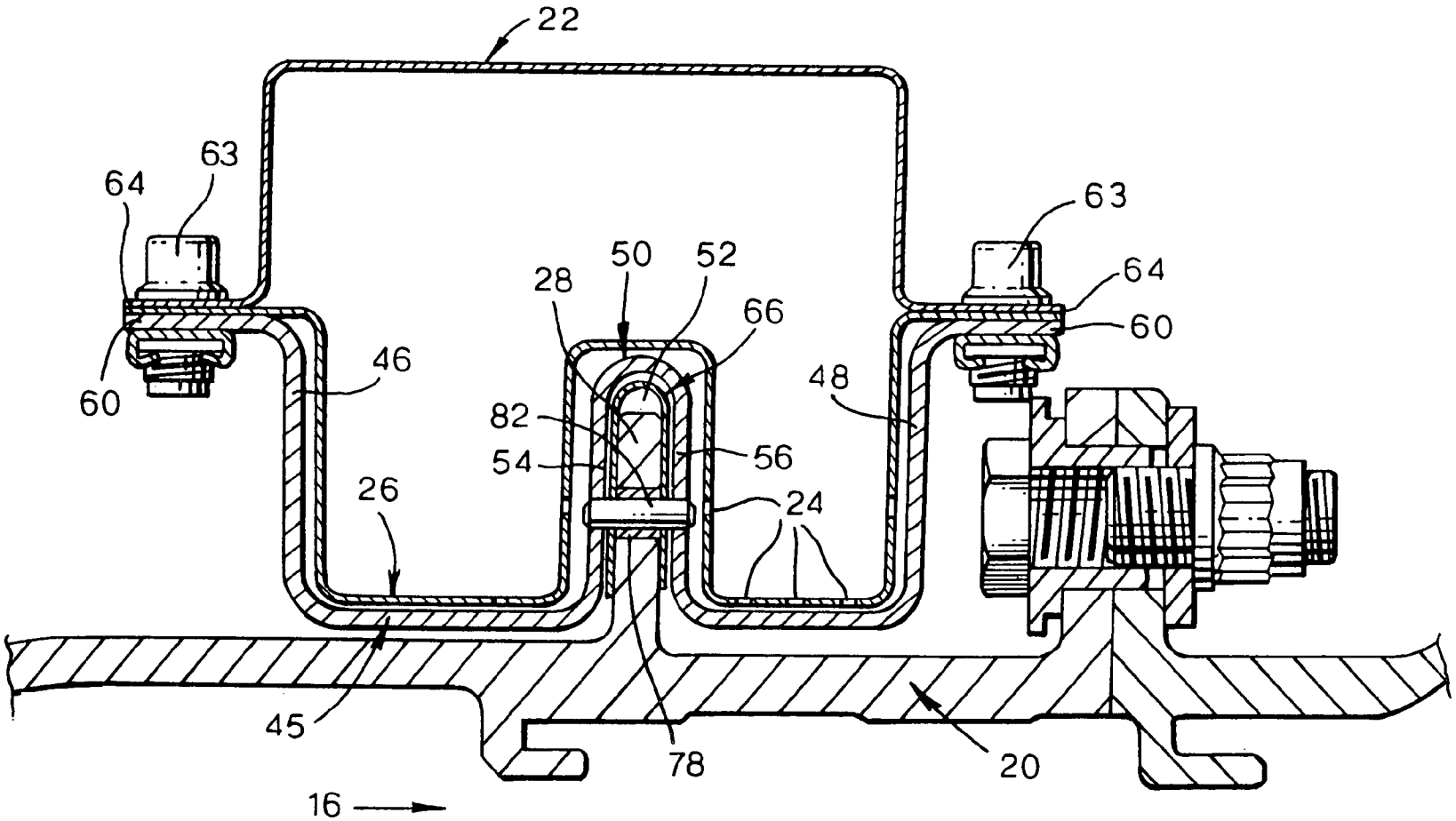
FIG. 2 is a cross sectional circumferential view showing part of a casing which can surround a turbine.
Figure 3:
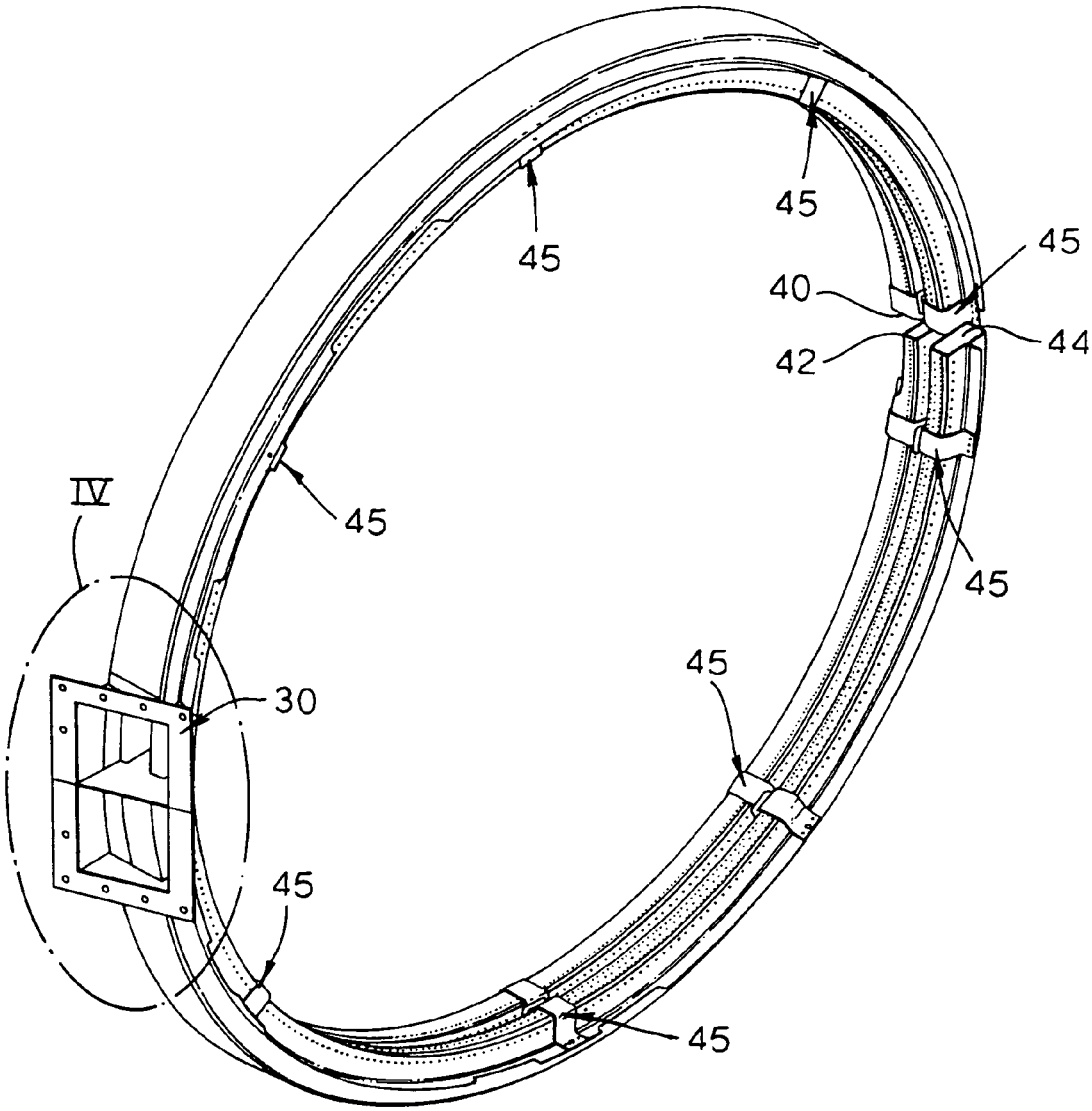
FIG. 3 is a perspective view of a manifold arrangement.
Figure 5:
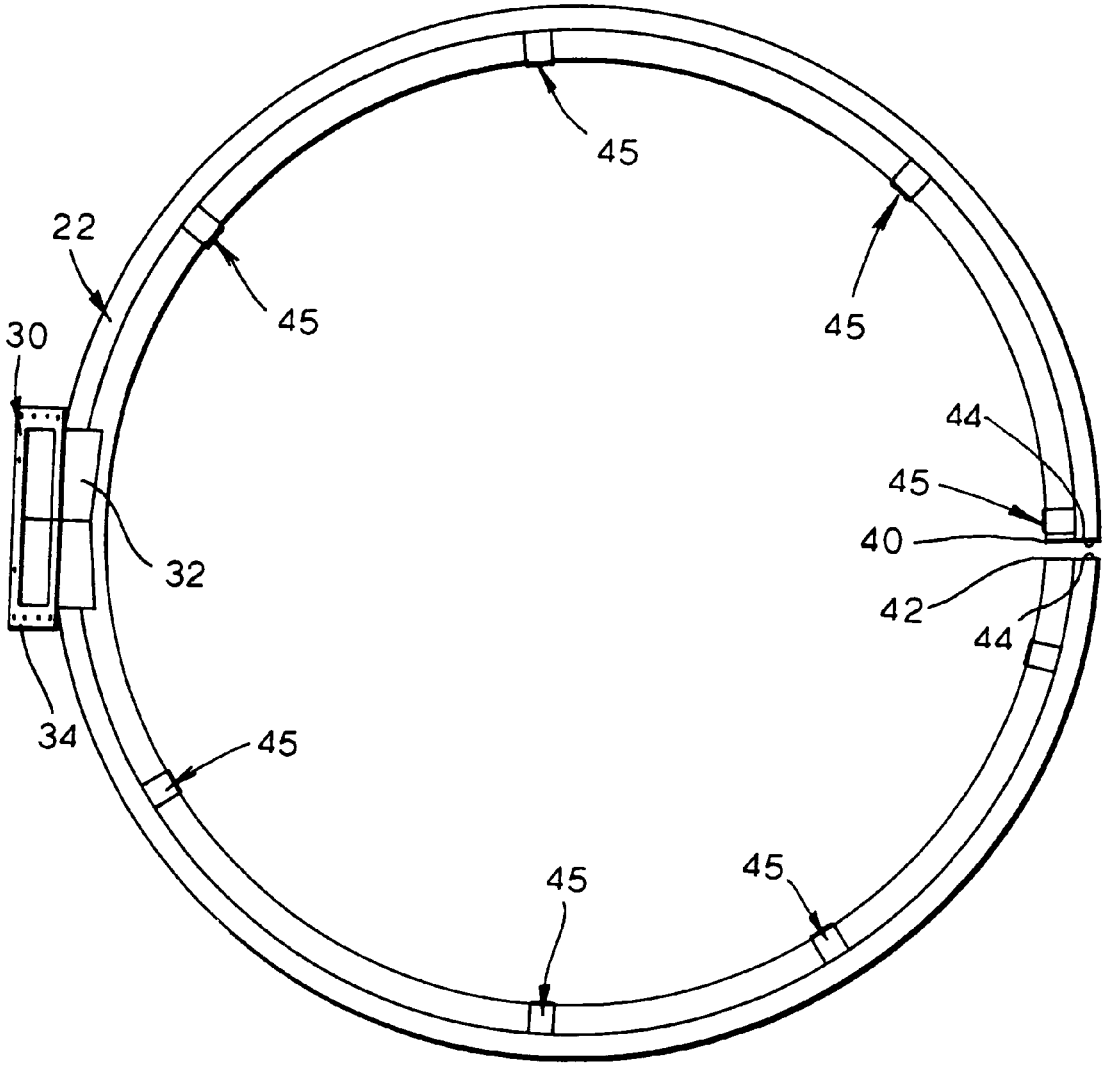
FIG. 5 is a rear view of the manifold arrangement shown in FIG. 3.

The high temperature gases exhausted from the combustor 15 causes the casing of the high pressure turbine 16 to expand. In order to prevent or mitigate such expansion, cooling air from the by pass region is fed to the casing 20. FIG. 2 shows a close-up of the casing 20 surrounding the high pressure turbine 16 of the gas turbine engine 10. Mounted around the casing 20 is a manifold 22 which, as shown in FIGS. 3 and 5 is of an annular configuration. The manifold 22 extends around the casing 20. The manifold 22 provides cooling air to the casing 20 as described below.

As can be seen, from FIG. 2 the casing 20 comprises a radially outwardly extending flange 28 which is used for cooling purposes and to secure the manifold 22 to the casing 20. The inner wall 26 defines a plurality of apertures 24, and air flowing through the manifold 22 passes through the aperture 24 to impinge on the flange 28 and on other regions of the casing 20.

Figure 4:
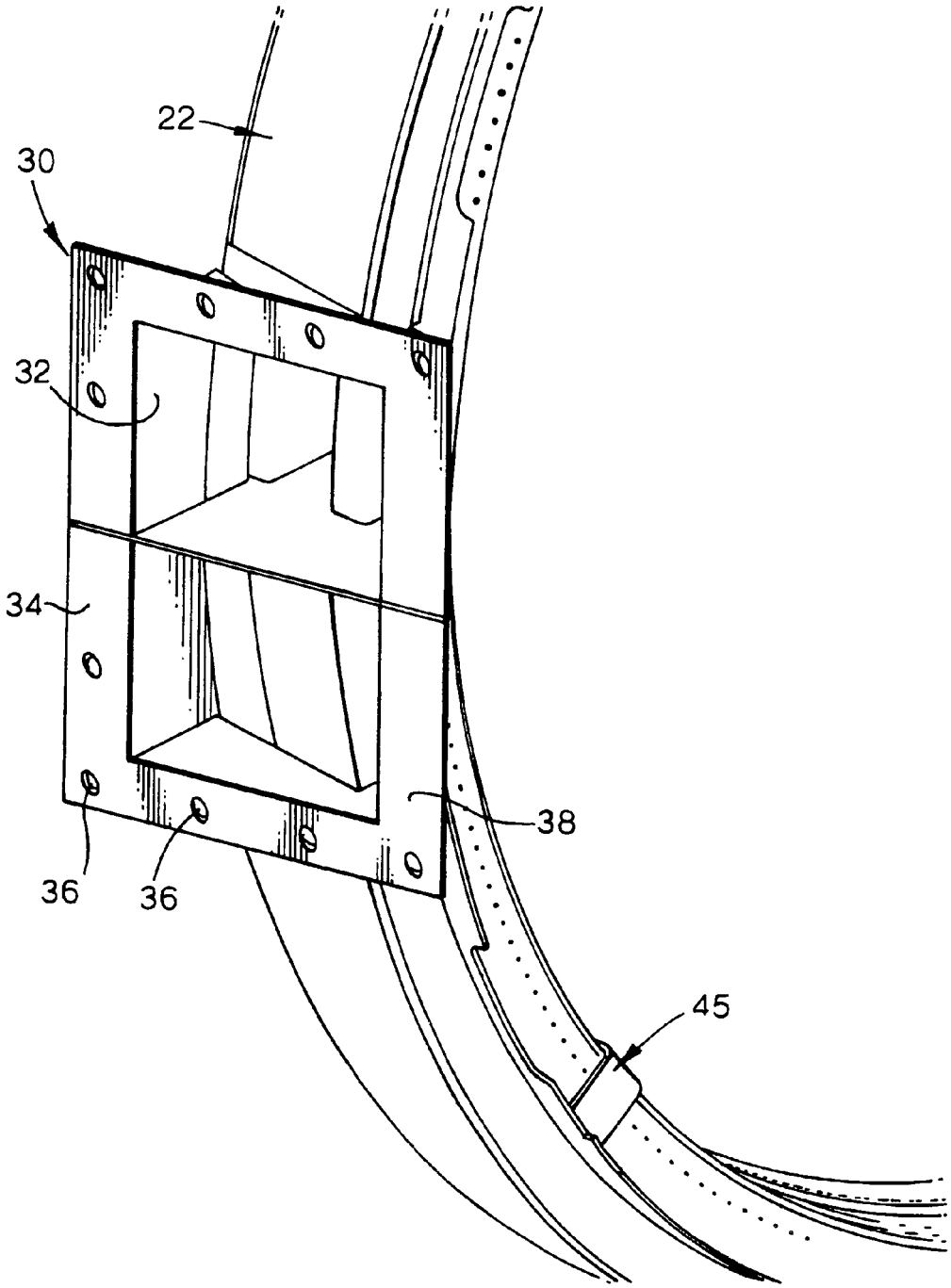
FIG. 4 is a close up view of the region marked IV in FIG. 3.

The manifold 22 is secured to the casing 20 by a securing arrangement as described below:

The manifold 22 includes an inlet 30 via which air from the by pass region of the engine 10 is supplied to the manifold 22. The inlet 30 is shown more clearly in FIG. 4, and comprises an inlet conduit 32 and a connecting flange 34 for connecting the inlet 30 to a feed pipe (not shown) communicating with the by pass region of the engine 10.

The connecting flange 34 defines a plurality of apertures 36 (see FIG. 4) to allow the connecting flange 34 to be connected to a corresponding flange (not shown) on the feed pipe by the use of bolts and nuts.

The connecting flange 34 defines an inlet face 38 and, as can be seen the inlet face is angled relative to the main axis of the manifold. The angle is conveniently about 20°.

FIG. 5 shows a rear plan view of the manifold. As can be seen the manifold 22 is generally annular in configuration. The manifold has ends 40, 42 which are provided adjacent each other. Each end 40, 42 has a wall 44 to prevent gas passing out of the ends 40, 42. A gap is defined between the ends 40, 42 to allow circumferential expansion and contraction due to changes in temperature of the casing 20 surrounded by the manifold 22.

FIG. 6 is an isometric view of a bracket 45 used to attach the manifold 22 to the casing 20. As can be seen from FIGS. 3 and 5 a plurality of brackets 45 are circumferentially spaced around the manifold 22. In the embodiment shown, there are eight such brackets 45.

The bracket 45 has a W shaped profile having end walls 46, 48 and a central upstanding portion 50 defining a recess 52. The upstanding portion 50 is formed by two opposed wall members 54, 56. Each of the wall members 54, 56 defines a slot 58 for receiving a securing member in the form of a pin to secure the bracket to the flange 28 of the casing 20, as will be explained below.

A respective attachment lug 60 extends outward from each wall member 46, 48. The attachment lugs 60 define apertures 62 to receive bolts 63 to secure the bracket 45 to the manifold 22 at corresponding lugs 64 thereon (see FIG. 2).

FIG. 7 shows a wear prevention means in the form of an anti-fret liner 66. The anti-fret liner 66 can be arranged over the flange 28 of the casing 20 between the flange 28 and the bracket 45, thereby preventing wear of the flange 28 caused by circumferential movement of the bracket 45 during thermal expansion and contraction of the casing 20.

The anti-fret liner 66 comprises a pair of generally parallel wall members 68, 70, each defining an aperture 72. The apertures 72 in the respective wall members 68, 70 are aligned with each other to allow the pin to be received therethrough.

FIGS. 8A to 8E shown the steps for mounting the manifold 22 to the casing 20.

Figure 8A:
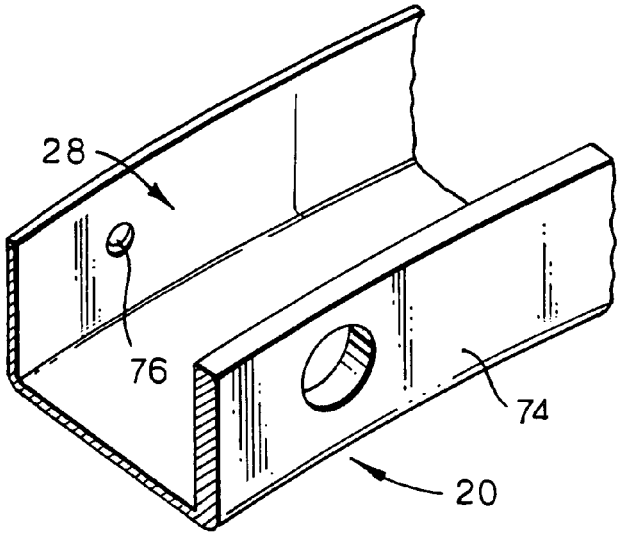
FIGS. 8A-8E show the steps in mounting the securing arrangement to the turbine.

FIG. 8A shows a region of the casing 20, showing the cooling flange 28 and a rear flange 74 used to bolt an adjacent casing (not shown) thereto. As can be seen the region of the casing 20 shown also shows an aperture 76 therethrough to allow the bracket 45 and the manifold 22 to be secured to the cooling flange 28.

Figure 8B:
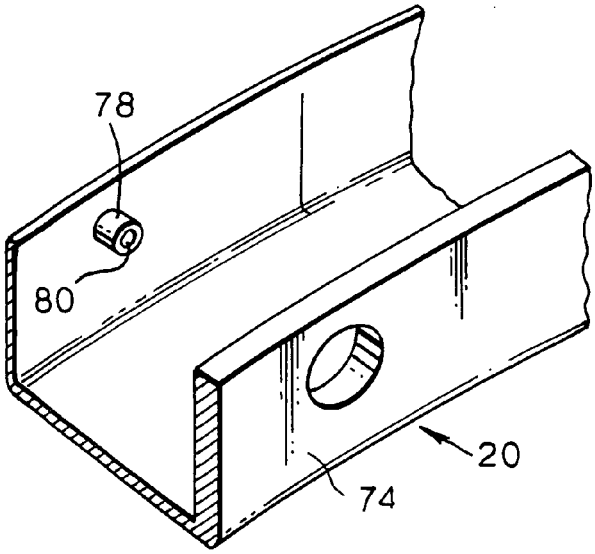

FIG. 8B shows the insertion of a bush 78 into the aperture 76. The bush is provided to prevent wear of the cooling flange 20 and is formed of a material that will wear rather than the material of the cooling flange 28. The bush 78 defines an internal bore 80 to receive a pin therethrough.

Figure 8C:
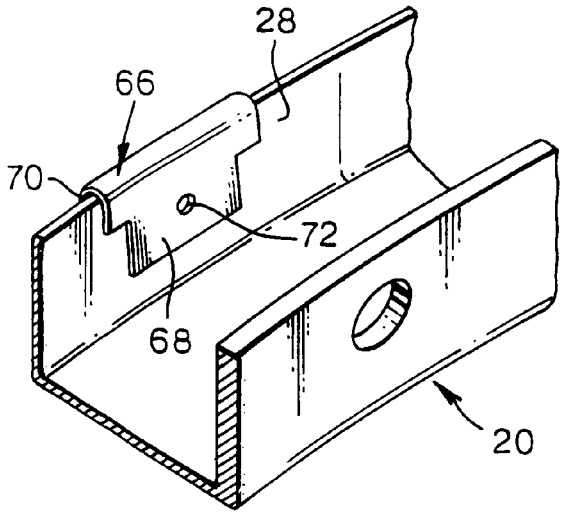

FIG. 8C shows the next step, which involves the arrangement of the anti-fret liner over the cooling flange 28 such that the apertures 72 in the wall members 68, 70 are aligned with the aperture 80 in the bush 78.

Figure 8D:
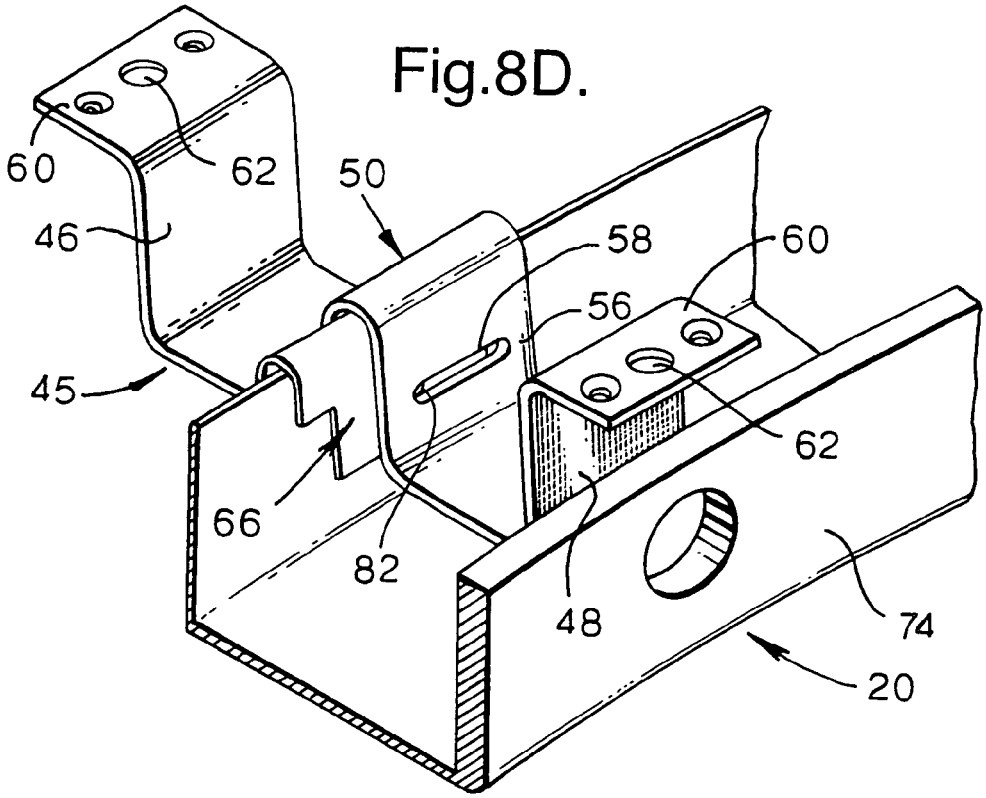

The next stage shown in FIG. 8D involves the arrangement of the bracket 45 over the anti-fret liner 66 such that the slots 58 are aligned with the apertures 72 in the anti-fret liner 66.

Figure 8E:
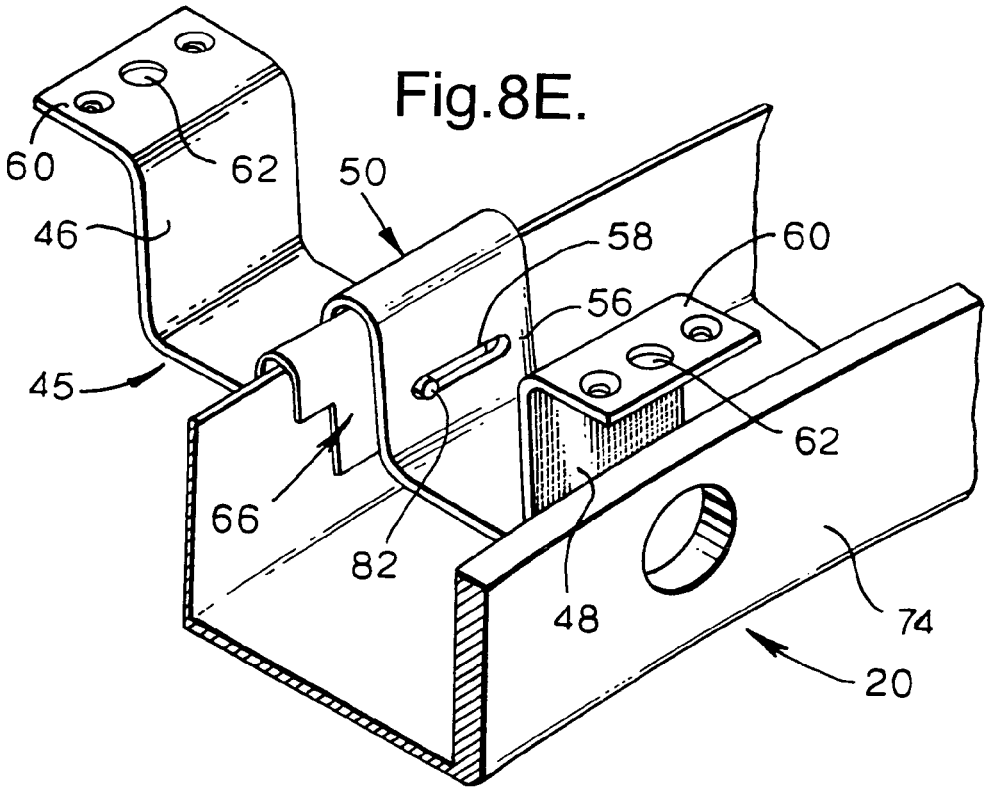

FIG. 8E shows the insertion of a pin 82 to extend through the slots 58 in both wall members 54, 56 of the bracket 45. The pin 82 also extends through the apertures 72 in the anti-fret liner 66 and through the aperture 80 in the bush 78. The pin 82 is an interference fit in the bush 78. As can be seen the pin 82 is inserted at one end of the slots 58. This allows the bracket to move relative to the cooling flange. The outer diameter of the bush 78 is greater than the width of the slot 58 in the bracket 45. This has the advantage in the preferred embodiment of the bracket 45 trapping the bush 78 in the aperture 76.

The manifold 22 is then bolted to the bracket 45 at the lugs 60 by bolts 63 through the apertures 62.

Various modifications can be made without departing from the scope of the invention.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

I claim:

1. A gas turbine engine comprising a casing surrounding a rotary assembly and a manifold secured to the casing via a securing arrangement, the manifold being configured to carry air, the securing arrangement comprising:

a bracket that is separate from the casing and the manifold, wherein the bracket comprises two opposing wall members in a central part of the bracket, and attachment lugs at two end portions of the bracket, the bracket that includes the two opposing wall members and the attachment lugs is a one-piece member, and the two opposing wall members define a recess;

a radially outwardly extending part of the casing located between the wall members of the bracket;

a securing unit that extends through the wall members of the bracket and the radially outwardly extending part of the casing; and fasteners that fasten the attachment lugs of the bracket to the manifold;

wherein:

the bracket is located between the manifold and the casing, and the bracket is secured to the casing through the wall members at the central part of the bracket and is secured to the manifold through the attachment lugs at both end portions of the bracket, and the manifold comprises an inner wall that faces the bracket, the inner wall has a configuration corresponding to a configuration of the bracket including the two opposite wall members, and the inner wall has a plurality of apertures through which the air is configured to flow and impinge on the casing including the radially outwardly extending part.

2. The gas turbine engine according to claim 1, wherein the securing means comprises an insertion means insertable into the radially outwardly extended part of the casing.

3. The gas turbine engine according to claim 2, wherein the insertion means comprise an insertion member.

4. The gas turbine engine according to claim 3, wherein the insertion member is insertable into an aperture in the radially outwardly extending part of the casing.

5. The gas turbine engine according to claim 3, wherein the insertion means further comprise a bush having an aperture into which the insertion member can be inserted.

6. The gas turbine engine according to claim 5, wherein the bush is insertable into the radially outwardly extending part of the casing.

7. The gas turbine engine according to claim 5, wherein the bush defines an aperture into which the insertion member can be inserted.

8. The gas turbine engine according to claim 3, wherein the bracket is of a W shaped configuration, and comprises an upstanding portion, to define the recess.

9. The gas turbine engine according to claim 8, wherein the upstanding portion is centrally provided on the bracket, and the upstanding portion comprises the opposed wall members.

10. The gas turbine engine according to claim 8, wherein the upstanding portion defines an aperture for the insertion member.

11. The gas turbine engine according to claim 10, wherein the aperture is a slot which has a longitudinal axis which is generally parallel to the circumference of the manifold.

12. The gas turbine engine according to claim 11, wherein the slot is provided in the upstanding portion to allow circumferential movement of the bracket on expansion of the casing.

13. The gas turbine engine according to claim 11, wherein the upstanding portion comprises opposed wall members, and a slot is provided in each wall member.

14. The gas turbine engine according to claim 13, wherein the slots are aligned with each other.

15. The gas turbine engine according to claim 3, wherein protection means is provided between the bracket and the radially outwardly extending part of the casing.

16. The gas turbine engine according to claim 15, wherein the protection means defines an aperture through which the insertion member can be inserted.

17. The gas turbine engine according to claim 15, wherein the protection means comprises an anti-fret liner to prevent wear of one or both of the bracket and the manifold.

18. The gas turbine engine according to claim 1, wherein each fastener comprises a bolt, and the end portions define an aperture for receipt of the bolt.

19. A manifold assembly comprising a manifold and a securing arrangement as claimed in claim 1 for securing the manifold to a casing of a rotary assembly.

20. A manifold assembly according to claim 19, wherein the manifold is generally annular in configuration.

21. A manifold assembly according to claim 19, wherein the manifold comprises an inlet member to allow fluid to enter the manifold, the inlet member comprising an entrance face which is non-parallel to a main axis of the manifold.

22. A manifold assembly comprising a manifold having a main axis and a securing arrangement as claimed in claim 1 for securing the manifold to a casing on a rotary component, wherein the manifold comprises an inlet member to allow fluid to enter the manifold, the inlet member having an entrance face which is non-parallel to the main axis of the manifold.

23. A manifold assembly according to claim 22, wherein the securing arrangement includes a bracket defining a recess co-operable with a radially outwardly extending part of the casing, and securing means for securing the bracket to the aforesaid radially outwardly extending part.

24. A rotary assembly incorporating a manifold assembly according to claim 23.

25. A gas turbine engine incorporating a rotary assembly as claimed in claim 24.

26. A gas turbine engine according to claim 25 wherein the rotary assembly comprises a turbine.

* * * * *